US010319515B2

(12) United States Patent
Jung et al.

(10) Patent No.: US 10,319,515 B2
(45) Date of Patent: Jun. 11, 2019

(54) CHIP ELECTRONIC COMPONENT

(71) Applicant: SAMSUNG ELECTRO-MECHANICS CO., LTD., Suwon-si, Gyeonggi-do (KR)

(72) Inventors: Jung hyuk Jung, Suwon-si (KR); Woon Chul Choi, Suwon-si (KR); Jun Ah, Suwon-si (KR); Myung Jun Park, Suwon-si (KR); Hye Min Bang, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 4 days.

(21) Appl. No.: 15/047,214

(22) Filed: Feb. 18, 2016

(65) Prior Publication Data

US 2016/0343500 A1 Nov. 24, 2016

(30) Foreign Application Priority Data

May 19, 2015 (KR) ..... 10-2015-0069721

(51) Int. Cl.
*H01F 27/29* (2006.01)
*H01F 17/00* (2006.01)
(Continued)

(52) U.S. Cl.
CPC ..... *H01F 27/292* (2013.01); *H01F 17/0013* (2013.01); *H01F 17/04* (2013.01);
(Continued)

(58) Field of Classification Search
CPC ..... H01F 5/00; H01F 27/28
(Continued)

(56) References Cited

U.S. PATENT DOCUMENTS 7,176,773 B2 2/2007 Shoji
7,821,371 B2 10/2010 Inoue et al.
(Continued)

FOREIGN PATENT DOCUMENTS

CN 1258777 C 6/2006
CN 101300648 A 11/2008
(Continued)

OTHER PUBLICATIONS

Chinese Office Action issued in Application No. 201610124545.2 dated Jul. 14, 2017, with English translation.

*Primary Examiner* — Tszfung J Chan
(74) *Attorney, Agent, or Firm* — Morgan Lewis & Bockius LLP

(57) ABSTRACT

A chip electronic component includes a magnetic main body including an insulating substrate and a coil conductor pattern disposed on at least one surface of the insulating substrate, and external electrodes formed on opposite ends of the magnetic main body so as to be connected to an end of the coil conductor pattern. The coil conductor pattern includes a pattern plating layer and a first plating layer disposed on the pattern plating layer, and a thickness of the first plating layer of innermost and outermost coil conductor patterns of the coil conductor pattern is greater than a thickness of the first plating layer of an inner coil conductor pattern disposed between the innermost and outermost coil conductor patterns.

14 Claims, 3 Drawing Sheets

(51) Int. Cl.
*H01F 41/04* (2006.01)
*H01F 17/04* (2006.01)

(52) U.S. Cl.
CPC ..... *H01F 41/042* (2013.01); *H01F 41/046* (2013.01); *H01F 2017/048* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 9,236,171 | B2 | 1/2016 | Ito et al. | |
| 9,236,173 | B2 | 1/2016 | Yoo et al. | |
| 2004/0164835 | A1* | 8/2004 | Shoji | H01F 17/0013 336/200 |
| 2009/0243780 | A1* | 10/2009 | Inoue | H01F 1/15366 336/200 |
| 2010/0259353 | A1 | 10/2010 | Saito et al. | |
| 2013/0147592 | A1* | 6/2013 | Yoo | H01F 5/003 336/200 |
| 2013/0222101 | A1* | 8/2013 | Ito | H01F 17/04 336/83 |

FOREIGN PATENT DOCUMENTS

| | | | | |
|---|---|---|---|---|
| CN | 103165259 | A | | 6/2013 |
| CN | 103180919 | A | | 6/2013 |
| CN | 103695972 | A | | 4/2014 |
| JP | 05075237 | A | * | 3/1993 |
| JP | 10241983 | A | * | 9/1998 |
| JP | 11-204337 | A | | 7/1999 |
| JP | 2001267166 | A | * | 9/2001 |
| JP | 2003-332133 | A | | 11/2003 |
| JP | 2004319570 | A | * | 11/2004 |
| JP | 2005-109097 | A | | 4/2005 |
| JP | 2006-278909 | A | | 10/2006 |
| JP | 2014080674 | A | * | 5/2014 |
| KR | 10-2010-0113029 | A | | 10/2010 |

* cited by examiner

CHIP ELECTRONIC COMPONENT

CROSS-REFERENCE TO RELATED APPLICATION

This application claims the benefit of priority to Korean Patent Application No. 10-2015-0069721, filed on May 19, 2015 with the Korean Intellectual Property Office, the entirety of which is incorporated herein by reference.

TECHNICAL FIELD

The present disclosure relates to a chip electronic component and a board for mounting the same.

BACKGROUND

An inductor is a type of chip electronic component, and is a representative passive device that may constitute a component in an electronic circuit along with a resistor and a capacitor to remove noise therefrom. In addition, it may be used to configure a resonance circuit for amplifying a signal within a specific frequency band via a combination with a capacitor using electromagnetic characteristics, a filter circuit, and so on.

Recently, the drive towards the miniaturization and thinning of information technology (IT) devices such as communications devices and display devices has accelerated. In accordance with this, research into various miniaturized and thinned devices such as inductors, capacitors, and transistors employed in the IT device has also been continuously conducted. For example, inductors have been rapidly converted into a chip that is miniaturized and able to be automatically mounted on a surface with a high density, and a thin-film type inductor formed by mixing magnetic powder with resin on a coil pattern formed by plating on upper and lower surfaces of a thin insulating substrate has been continuously developed.

The thin-film type inductor may be manufactured by forming a coil pattern on an insulating substrate and then filling an outer portion of the main body with a magnetic material.

A plated area is important to enhance direct current resistance Rdc, an important characteristic of the inductor. To this end, an anisotropic plating scheme of applying high current density to only grow plating layers in a direction above a coil has been applied.

In detail, in a substrate plating procedure for forming a coil of the inductor, a primary pattern plating procedure is performed, and then secondary plating is performed by coating an insulating material such as a solder resist (SR) or a dry film resist (DFR) on a specific portion of the coil.

In general, internal plating layers, which are the plating layers except for an outermost plating layer and an innermost plating layer, have relatively constant plating widths and thicknesses due to adjacent plating layers in opposite directions in the secondary plating procedure after the primary plating.

However, since the outermost plating layer and the innermost plating layer have no adjacent plating layer on one side, plating material may be excessively plated on that side during the secondary plating. Accordingly, in general the outermost and innermost coil conductor patterns have a greater plating width than an inner coil conductor pattern.

In addition, since the outermost plating layer and the innermost plating layer have no adjacent plating layer on one side and a dam such as a solder resist (SR) or a dry film resist (DFR) is disposed, copper ion supply may be insufficient, and thus a plating layer may be slowly grown in a thickness direction such that distribution with a plating thickness of all coil conductor patterns occurs.

Due to the above distribution with the plating thickness, it may be difficult to achieve designed capacity or to achieve direct current Rdc characteristics.

SUMMARY

An aspect of the present disclosure provides a chip electronic component and a board for mounting the same.

According to an aspect of the present disclosure, a chip electronic component includes a magnetic main body including an insulating substrate and a coil conductor pattern disposed on at least one surface of the insulating substrate, and external electrodes formed on opposite ends of the magnetic main body so as to be connected to an end of the coil conductor pattern, in which the coil conductor pattern includes a pattern plating layer and a first plating layer disposed on the pattern plating layer, and a thickness of the first plating layer of innermost and outermost coil conductor patterns of the coil conductor pattern is greater than a thickness of the first plating layer of an inner coil conductor pattern disposed between the innermost and outermost coil conductor patterns.

Thicknesses of the first plating layer of the inner coil conductor patterns may be the same.

The expression Wa'<Wa may be satisfied, where Wa is a width of a pattern plating layer of innermost and outermost coil conductor patterns of the coil conductor patterns and Wa' is a width of a pattern plating layer of the inner coil conductor pattern disposed between the innermost and outermost coil conductor patterns.

Widths of the pattern plating layer of the inner coil conductor patterns may be the same.

The coil conductor pattern may further include a second plating layer disposed on the first plating layer.

The second plating layer may be disposed on an upper surface of the first plating layer.

A width of the second plating layer may be substantially the same as a width of the first plating layer.

According to another aspect of the present disclosure, a chip electronic component includes a magnetic main body including an insulating substrate and a coil conductor pattern disposed on at least one surface of the insulating substrate, and external electrodes formed on opposite ends of the magnetic main body so as to be connected to an end of the coil conductor pattern, in which the coil conductor pattern includes a pattern plating layer and a first plating layer disposed on the pattern plating layer. When a width of a pattern plating layer of innermost and outermost coil conductor patterns of the coil conductor patterns is Wa and a width of a pattern plating layer of an inner coil conductor pattern between the innermost and outermost coil conductor patterns is Wa', Wa'<Wa is satisfied.

According to another aspect of the present disclosure, a board for mounting a chip electronic component includes a printed circuit board (PCB) including first and second electrode pads disposed on the PCB, and the chip electronic component as described above installed on the PCB.

According to another aspect of the present disclosure, a method of manufacturing a chip electronic component comprises steps of: forming a coil conductor pattern by forming a pattern plating layer on an insulating substrate and forming a first plating layer on the pattern plating layer; forming a magnetic main body around the coil conductor pattern; and forming external electrodes on first and second end surfaces of the magnetic main body so as to connect to ends of the coil conductor pattern. The expression Wa'<Wa is satisfied, where Wa is a width of a pattern plating layer of innermost and outermost coil conductor patterns of the coil conductor patterns and Wa' is a width of a pattern plating layer of an inner coil conduct pattern disposed between the innermost and outermost coil conductor patterns.

BRIEF DESCRIPTION OF THE DRAWINGS

The above and other aspects, features and other advantages of the present disclosure will be more clearly understood from the following detailed description taken in conjunction with the accompanying drawings.

DETAILED DESCRIPTION

Figure 1:
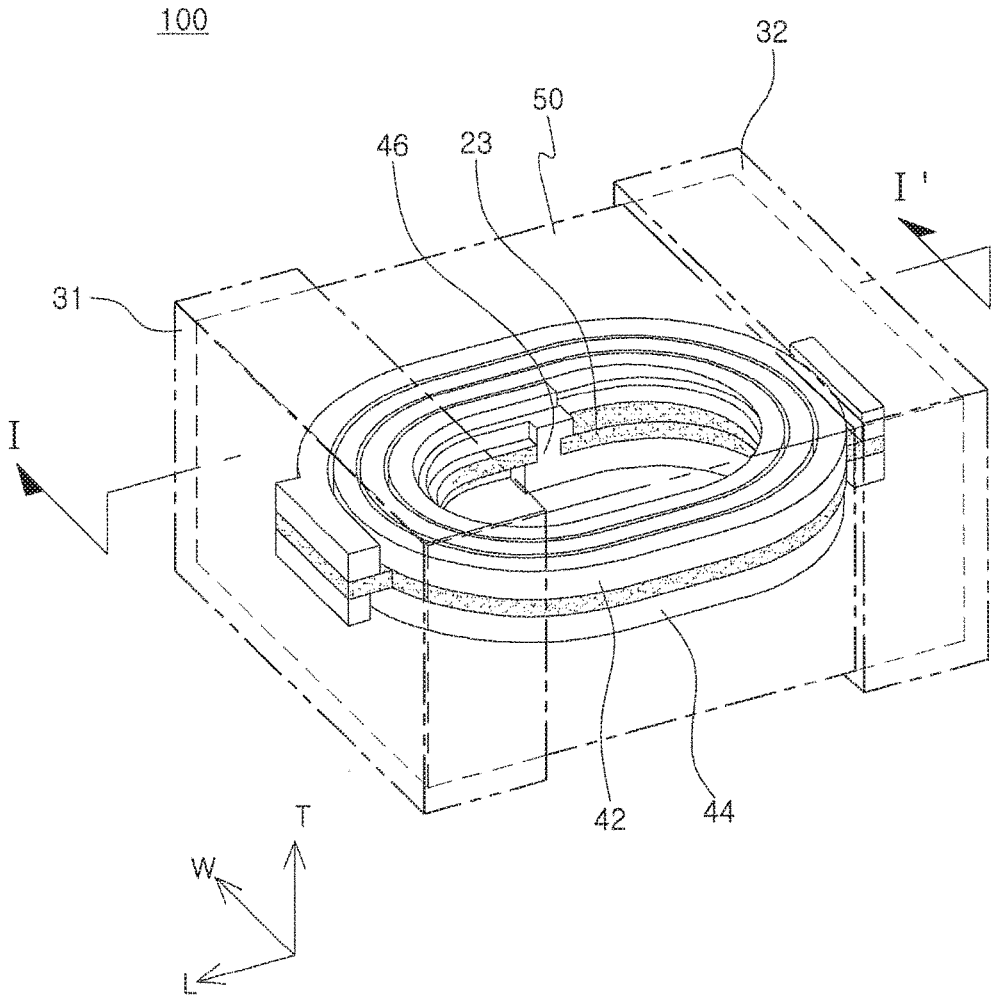
FIG. 1 is a schematic perspective view illustrating an internal coil pattern of a chip electronic component according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Chip Electronic Component

Hereinafter, a chip electronic component according to an exemplary embodiment in the present disclosure will be described with regard to, in particular, a thin film type inductor, but is not limited thereto.

FIG. 1 is a schematic perspective view illustrating an internal coil pattern of a chip electronic component according to an exemplary embodiment in the present disclosure.

Figure 2:
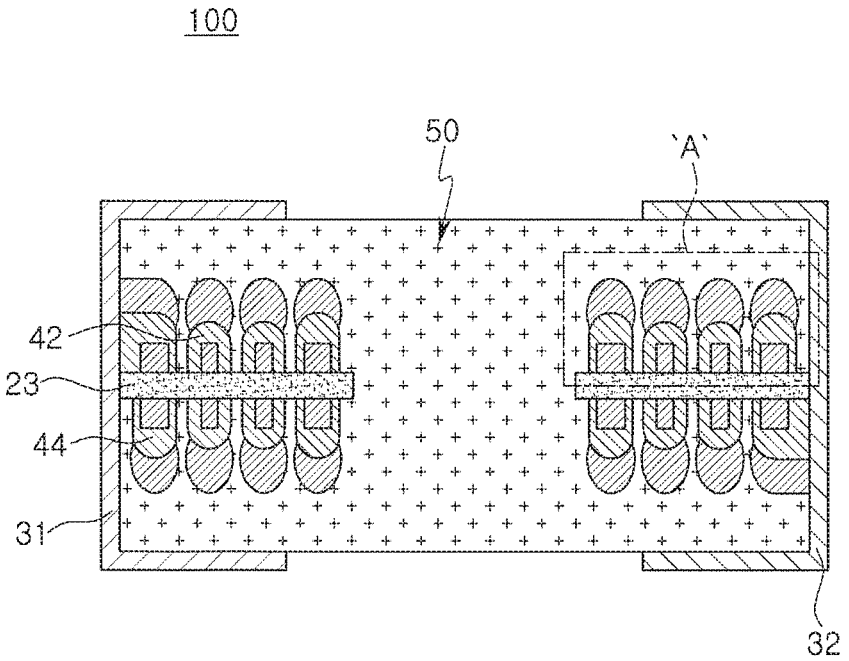
FIG. 2 is a cross-sectional view of a thin film type inductor taken along line I-I' of FIG. 1.
Figure 3:
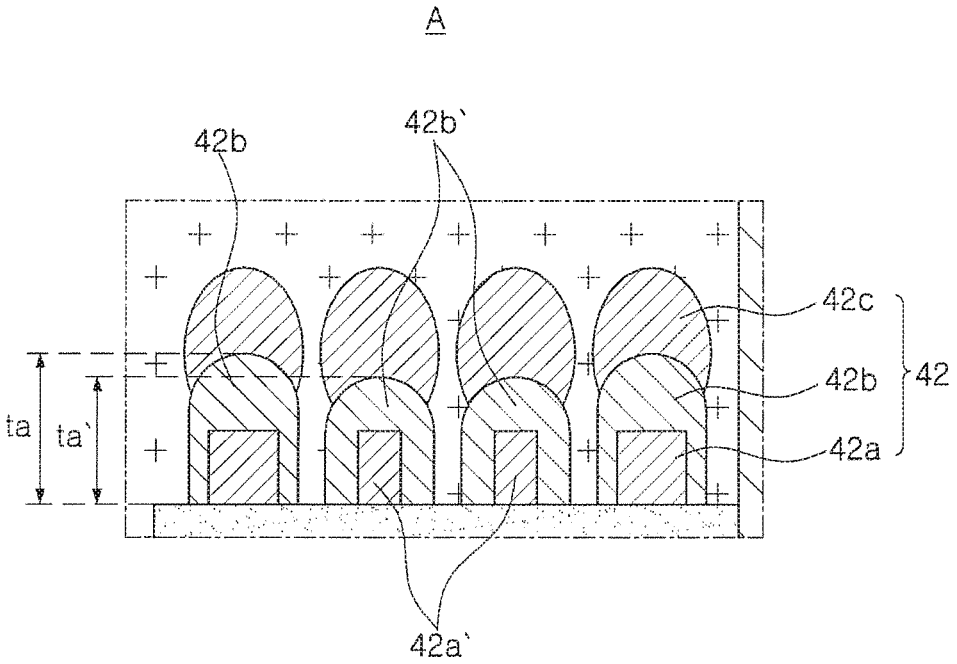
FIG. 3 is a schematic enlarged view of a portion A of FIG. 2.

FIG. 2 is a cross-sectional view of a thin film type inductor 100 taken along line I-I' of FIG. 1. FIG. 3 is a schematic enlarged view of a portion A of FIG. 2.

Referring to FIGS. 1 to 3, the thin film type inductor 100 used in a power line of a power supply circuit is disclosed as an example of a chip electronic component. The chip electronic component may be appropriately applied in the form of chip beads, a chip filter, and so on.

The thin film type inductor 100 may include a magnetic main body 50, an insulating substrate 23, and coil conductor patterns 42 and 44.

The thin film type inductor 100 may be manufactured by forming the coil conductor patterns 42 and 44 on the insulating substrate 23 and then filling outer portions of the main body 50 with a magnetic material.

A plated area is important to enhance direct current resistance Rdc, an important characteristic of the thin film type inductor 100. To this end, an anisotropic plating scheme for applying current having high current density to grow a plating layer only in a direction above a coil has been applied.

In detail, in an insulating substrate plating procedure for forming a coil of the inductor, a primary pattern plating procedure is performed, and then secondary plating is performed by coating an insulating material such as a solder resist (SR) or a dry film resist (DFR) on a specific portion of the coil.

A pattern plating layer may be formed by the primary pattern plating procedure. In this regard, in the primary pattern plating procedure, a photo resist may be coated on the insulating substrate, a coil conductor pattern may be exposed, transferred, and developed using a photo mask to maintain a portion of the photo resist, not exposed to light, and plating may be performed in this state and the maintained portion of the photo resist may be removed to form the pattern plating layer.

After the primary pattern plating procedure is performed, secondary plating may be performed on the insulating substrate to grow a plating layer, and thus, the coil conductor patterns 42 and 44 may be disposed above and below the insulating substrate 23, respectively.

A general thin film type inductor may require high inductance L and low direct current resistance Rdc, and in particular, is a component mainly used in a case in which deviation between inductance values for respective frequencies is required to be low.

The magnetic main body 50 may form outer surfaces of the thin film type inductor 100, may be formed of any material having magnetic properties, and may be formed of, for example, a ferritic or a metallic soft magnetic material.

Examples of the ferrite may include Mn—Zn ferrite, Ni—Zn ferrite, Ni—Zn—Cu ferrite, Mn—Mg ferrite, Ba ferrite, or Li ferrite.

Examples of the metallic soft magnetic material may include an alloy including one or more selected from the group consisting of Fe, Si, Cr, Al, and Ni, and may include, but is not limited to, for example, Fe—Si—B—Cr amorphous metallic particles.

A particle diameter of the metallic soft magnetic material may be 0.1 μm to 30 μm and the metallic soft magnetic material may be included to be distributed on a polymer such as epoxy resin or polyimide.

The magnetic main body 50 may have a hexahedral shape. Defining directions of the hexahedral shape for description of the present disclosure, L, W, and T in FIG. 1 may refer to a length direction, a width direction, and a thickness direction, respectively.

The insulating substrate 23 formed in the magnetic main body 50 may be formed as a thin film, and may be formed of any material as long as the coil conductor patterns 42 and 44 are formed by plating. For example, the insulating substrate may be formed as a PCB substrate, a ferrite substrate, a metallic soft magnetic substrate, or the like.

A hole may be formed in a central portion of the insulating substrate 23 and may be filled with a magnetic substance such as ferrite or metallic soft magnetic material to form a core part. As the core portion filled with the magnetic substance is formed, inductance L may be enhanced.

The coil conductor pattern 42 having a coil pattern may be formed on a first surface of the insulating substrate 23, and the coil conductor pattern 44 having a coil pattern may be formed on a second surface of the insulating substrate 23 opposite the first surface.

The coil conductor patterns 42 and 44 may be coil patterns having a spiral shape. The coil conductor patterns 42 and 44 formed on the first and second surfaces of the insulating substrate 23 may be electrically connected to each other through a via electrode 46 formed in the insulating substrate 23.

The coil conductor patterns 42 and 44 and the via electrode rode 46 may be formed to include metal having excellent electroconductive properties, for example, silver (Ag), palladium (Pd), aluminum (Al), nickel (Ni), titanium (Ti), gold (Au), copper (Cu), platinum (Pt), or an alloy of two or more thereof.

Although not illustrated, an insulating film may be formed on surfaces of the coil conductor patterns 42 and 44.

The insulating film may be formed using known methods such as screen printing, a procedure via exposure and development of a photo resist (PR), spray coating, and dipping.

The form of the insulating film is not particularly limited as long as the insulating film is formed as a thin film, but for example, the insulating film may be formed to include a photo resist (PR), epoxy resin, and so on.

One end of the coil conductor pattern 42 formed on the first surface of the insulating substrate 23 may be exposed toward a first end surface in a length direction of the magnetic main body 50, and one end of the coil conductor pattern 44 formed on the second surface of the insulating substrate 23 may be exposed toward a second end surface in the length direction of the magnetic main body 50 opposite the first end surface.

External electrodes 31 and 32 may be formed on the first and second end surfaces in the length direction so as to be connected to the coil conductor patterns 42 and 44 that are exposed toward the first and second end surfaces in the length direction of the magnetic main body 50.

The external electrodes and 32 may extend to external surfaces in the thickness direction of the magnetic main body 50 from opposite lateral surfaces in the length direction and/or to opposite lateral surfaces in the width direction of the magnetic main body 50.

In addition, the external electrodes 31 and 32 may be formed on upper and/or lower surfaces of the magnetic main body 50 and may extend to opposite end surfaces in the length direction and/or the width direction of the magnetic main body 50.

That is, an arrangement of the external electrodes 31 and 32 may not be particularly limited, and thus the external electrodes 31 and 32 may be arranged in various manners.

The external electrodes 31 and 32 may be formed of metal having excellent electroconductive properties. For example, nickel (Ni), copper (Cu), tin (Sn), and silver (Ag) may be used alone or in an alloy of two or more thereof.

Referring to FIG. 1, the coil conductor patterns 42 and 44 may be disposed in parallel to a lower surface of the magnetic main body 50 but are not limited thereto, and thus the coil conductor patterns 42 and 44 may alternatively be disposed to be perpendicular to the lower surface.

Referring to FIGS. 2 and 3, the coil conductor patterns 42 and 44 may include pattern plating layers 42*a* and 42*a*' and first plating layers 42*b* and 42*b*' formed on the pattern plating layers 42*a* and 42*a*'. With regard to an end surface of the magnetic main body 50 in the length direction, a thickness ta of the first plating layer 42*b* of outermost and innermost coil conductor patterns of the coil conductor patterns 42 and 44 may be greater than a thickness ta' of the first plating layer 42*b*' of an inner coil conductor pattern disposed between the innermost and outermost coil conductor patterns (ta'<ta).

Although FIG. 3 illustrates the pattern plating layers 42*a* and 42*a*', the first plating layers 42*b* and 42*b*', and a second plating layer 42*c* to be described below by enlarging only an internal structure of one coil conductor pattern 42 of the coil conductor patterns 42 and 44, it will be obvious that the other conductor pattern 44 may have the above structure.

The pattern plating layers 42*a* and 42*a*' may each be a pattern plating layer formed by forming a plating resist patterned on the insulating substrate 23 and filling an opening with a conductive metal.

The first plating layers 42*b* and 42*b*' may be formed by electroplating and may each be an isotropic plating layer that is simultaneously grown in a width direction W and a height direction T of a coil.

The second plating layer 42*c* may be formed by electroplating and may be an anisotropic plating layer formed via growth only in the height direction T while suppressing growth in the width direction W of the coil.

Current density, concentration of a plating solution, plating speed, and so on may be adjusted to form the first plating layers 42*b* and 42*b*' as an isotropic plating layer and to form the second plating layer 42*c* as an anisotropic plating layer.

That is, according to an exemplary embodiment in the present disclosure, the coil conductor patterns 42 and 44 may further include the second plating layer 42*c* disposed on the first plating layers 42*b* and 42*b*', and the second plating layer 42*c* may be disposed on upper surfaces of the first plating layers 42*b* and 42*b*'.

As such, the pattern plating layers 42*a* and 42*a*' may be formed on the insulating substrate 23, the first plating layers 42*b* and 42*b*' may be formed as an isotropic plating layer covered on the pattern plating layers 42*a* and 42*a*', the second plating layer 42*c* as an anisotropic plating layer may be formed on the first plating layers 42*b* and 42*b*' so as to prevent short circuits occurring between coils while facilitating growth in the height direction of the coil, thereby obtaining an internal coil portion with a high aspect ratio (AR), for example, an aspect ratio (AR) (T/W) of 1.2 or more.

In general, in the secondary plating procedure after the primary plating, internal plating layers except for an outermost plating layer and an innermost plating layer have similar plating widths and thicknesses due to adjacent plating layers in opposite directions.

On the other hand, since the outermost plating layer and the innermost plating layer have no adjacent plating layer in one direction, plating may be excessive in one direction during the secondary plating. Accordingly, it is a common occurrence that the outermost and innermost coil conductor patterns have a greater plating width than inner coil conductor patterns.

In addition, since the outermost plating layer and the innermost plating layer have no adjacent plating layer in one direction and a dam such as a solder resist (SR) or a dry film resist (DFR) may be disposed, copper ion supply is insufficient, and thus a plating layer is slowly grown in a thickness direction such that distribution with a plating thickness of all coil conductor patterns occurs.

Due to the above distribution with the plating thickness, it is difficult to achieve intended capacity or to achieve desired direct current resistance (Rdc) characteristics.

However, according to an exemplary embodiment in the present disclosure, the thickness ta of the first plating layer 42*b* of the outermost and innermost coil conductor patterns of the coil conductor patterns 42 and 44 may be adjusted to be greater than the thickness ta' of the first plating layer 42*b*' of an inner coil conductor pattern disposed between the innermost and outermost coil conductor patterns. Thus, an area of an end surface of the coil conductor patterns constituting an inductor may be maximized, thereby minimizing current direct resistance Rdc.

In addition, direct current resistance Rdc designed by minimizing distribution with a plating thickness of all coil conductor patterns may be obtained.

That is, when the thickness ta of the first plating layer 42*b* of the outermost and innermost coil conductor patterns of the coil conductor patterns 42 and 44 is adjusted to be greater than the thickness ta' of the first plating layer 42*b*' of an inner coil conductor pattern disposed between the innermost and outermost coil conductor patterns, a dam may be disposed in one direction of the outermost and innermost plating layers. Thus, even if the plating layer is slowly grown in the thickness direction of the plating layer due to insufficient copper ion supply, plating thicknesses of all coil conductor patterns may be formed to be almost the same.

The thicknesses of the first plating layer 42*b*' of the inner coil conductor patterns may be the same.

That is, the thickness ta of the first plating layer 42*b* of the outermost and innermost coil conductor patterns of the coil conductor patterns 42 and 44 may be adjusted to be greater than the thickness ta' of the first plating layer 42*b*' of the inner coil conductor. The thicknesses of the first plating layer 42*b*' of the inner coil conductor patterns may be the same, and thus plating thicknesses of all coil conductor patterns may be formed to be almost the same.

In the above case, when plating layers or all coil conductor patterns have the same thickness, this may be interpreted as including deviation between thicknesses due to processing deviations during design and manufacture.

As described above, in order to form the first plating layer 42*b* of the outermost and innermost coil conductor patterns of the coil conductor patterns 42 and 44 with a greater thickness ta than the thickness ta' of the first plating layer 42*b*' of the inner coil conductor pattern, a pattern width of a pattern plating layer formed prior to formation of the first plating layer is important.

According to an exemplary embodiment in the present disclosure, the width of the pattern plating layer 42*a* of the outermost and innermost coil conductor patterns of the coil conductor patterns 42 and 44 may be greater than the width of the pattern plating layer 42*a*' of the inner coil conductor pattern between the outermost and innermost coil conductor patterns.

As described above, the width of the pattern plating layer 42*a* of the outermost and innermost coil conductor patterns of the coil conductor patterns 42 and 44 may be formed to be greater than the width of the pattern plating layer 42*a*' of the inner coil conductor pattern between the outermost and innermost coil conductor patterns, and thus the thickness ta of the first plating layer 42*b* of the outermost and innermost coil conductor patterns may be formed to be greater than the thickness ta' of the first plating layer 42*b*' of the inner coil conductor pattern.

Widths of the pattern plating layer 42*a*' of the inner coil conductor patterns may be the same but are not limited thereto.

Figure 4:
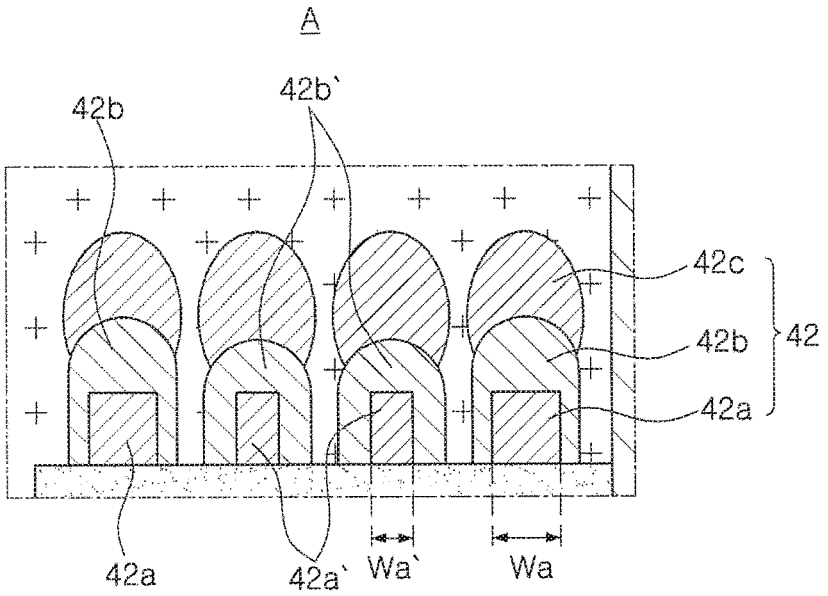
FIG. 4 is a schematic enlarged view of a portion A of FIG. 2 according to another exemplary embodiment in the present disclosure.

FIG. 4 is a schematic enlarged view of a portion A of FIG. 2 according to another exemplary embodiment in the present disclosure.

Referring to FIG. 4, a chip electronic component according to another exemplary embodiment in the present disclosure may include a magnetic main body including an insulating substrate and a coil conductor pattern formed on at least one surface of the insulating substrate, and external electrodes formed on opposite ends of the magnetic main body so as to be connected to ends of the coil conductor pattern.

The coil conductor pattern may include a pattern plating layer and a first playing layer disposed on the pattern plating layer, and with regard to end surface of the magnetic main body in a length direction, when a width of a pattern plating layer of innermost and outermost coil conductor patterns of the coil conductor patterns is Wa and a width of a pattern plating layer of an inner coil conductor pattern between the innermost and outermost coil conductor patterns is Wa', Wa'<Wa may be satisfied.

As shown in FIG. 4, a width of the second plating layer is substantially the same as a width of the first plating layer.

With regard to the same features of the chip electronic component according to the another exemplary embodiment in the present disclosure as the features of the chip electronic component according to the above exemplary embodiment in the present disclosure, repeated explanations thereof will not be provided.

Hereinafter, a method for manufacturing a chip electronic component according to an exemplary embodiment in the present disclosure will be described.

First, the coil conductor patterns 42 and 44 may be formed on the insulating substrate 23.

The coil conductor patterns 42 and 44 may be formed on the insulating substrate 23 as a thin film via electroplating or the like. In this case, the insulating substrate 23 may not be particularly limited. For example, the insulating substrate 23 may be a PCB substrate, a ferrite substrate, a metallic soft magnetic substrate, or the like, and may have a thickness of 40 to 100 μm.

A method for forming the coil conductor patterns 42 and 44 may be, for example, electroplating, but is not limited thereto. The coil conductor patterns 42 and 44 may be formed to include a metal with excellent electro conductive properties, for example, silver (Ag), palladium (Pd), aluminum (Al), nickel (Ni), titanium (Ti), gold (Au), copper (Cu), platinum (Pt), or an alloy of two or more thereof.

The via electrode 45 may be formed by forming a hole in a portion of the insulating substrate 23 and filling the hole with an electroconductive material, and the coil conductor patterns 42 and 44 formed on first and second surfaces of the insulating substrate 23 may be electrically connected to each other through the via electrode 46.

A process using drilling, laser drilling, sand blasting, punching processing, and so on, may be performed on a central portion of the insulating substrate 23 to form a hole through the insulating substrate 23.

During formation of the coil conductor patterns 42 and 44, a primary plating layer and a secondary plating layer may be further formed on a pattern plating layer formed by a printing scheme.

A plating resist with an opening for forming a pattern playing layer may be formed on the insulating substrate 23.

The plating resist may be a general photo resist film and may use a dry film resist or the like, but is not limited thereto.

According to an exemplary embodiment in the present disclosure, in order to form a first plating layer of outermost and innermost coil conductor patterns to have a greater thickness than a thickness of another first plating layer, openings for forming pattern plating layers may be formed to have different widths.

That is, the width of an opening of a corresponding portion of the outermost and innermost coil conductor patterns may be greater than the width of an opening of a corresponding portion of another coil conductor pattern.

Accordingly, the width of a pattern plating layer of the outermost and innermost coil conductor patterns may be greater than the width of another pattern plating layer, as described below.

A process such as electroplating may be applied to the opening for forming the pattern plating layer and the opening may be filled with electroconductive metal to form the pattern plating layer.

The pattern plating layer may be formed of a metal with excellent electroconductive properties, such as silver (Ag), palladium (Pd), aluminum (Al), nickel (Ni), titanium (Ti), gold (Au), copper (Cu), platinum (Pt), or an alloy of two or more thereof.

Then the plating resist may be removed via a process such as chemical etching.

When the plating resist is removed, the pattern plating layer may be maintained on the insulating substrate 23.

Electroplating may be formed on the pattern plating layer to form the primary plating layer covering the pattern plating layer.

Current density, concentration of a plating solution, plating speed, and so on may be adjusted during electroplating to form the first plating layers as an isotropic plating layer that is simultaneously grown in a width direction W and a height direction T of a coil.

In this case, according to an exemplary embodiment in the present disclosure, the thickness of the first plating layer of the outermost and innermost coil conductor patterns may be greater than the thickness of the first plating layer of another adjacent coil conductor pattern.

Then electroplating may be performed on the first plating layer to form a second plating layer.

Current density, concentration of a plating solution, plating speed, and so on may be adjusted during electroplating to form the second plating layer as an anisotropic plating layer formed by growth only in the height direction T while suppressing growth in the width direction W of the coil.

Then magnetic layers may be stacked above and below the insulating substrate 23 on which the coil conductor patterns 42 and 44 are formed, so as to form the magnetic main body 50.

The magnetic layers may be stacked on opposite surfaces of the insulating substrate 23 and pressurized via a laminate method or an isostatic pressing method to form the magnetic main body 50. In this case, a core portion may be formed so as to fill the hole with magnetic substances.

In addition, the external electrodes 31 and 32 may be formed to be connected to the coil conductor patterns 42 and 44, exposed through an end surface of the magnetic main body 50.

The external electrodes and 32 may be formed of paste including a metal with excellent electroconductive properties, and for example, electroconductive pastes including nickel (Ni), copper (Cu), tin (Sn), and silver (Ag) may be used alone or in alloy of two or more thereof. The external electrodes 31 and 32 may be formed by dipping as well as printing according to shapes of the external electrodes 31 and 32.

With regard to the same features as the features of the chip electronic component according to the above exemplary embodiment in the present disclosure, a detailed description thereof will be omitted here.

Board for Mounting Chip Electronic Component

Figure 5:
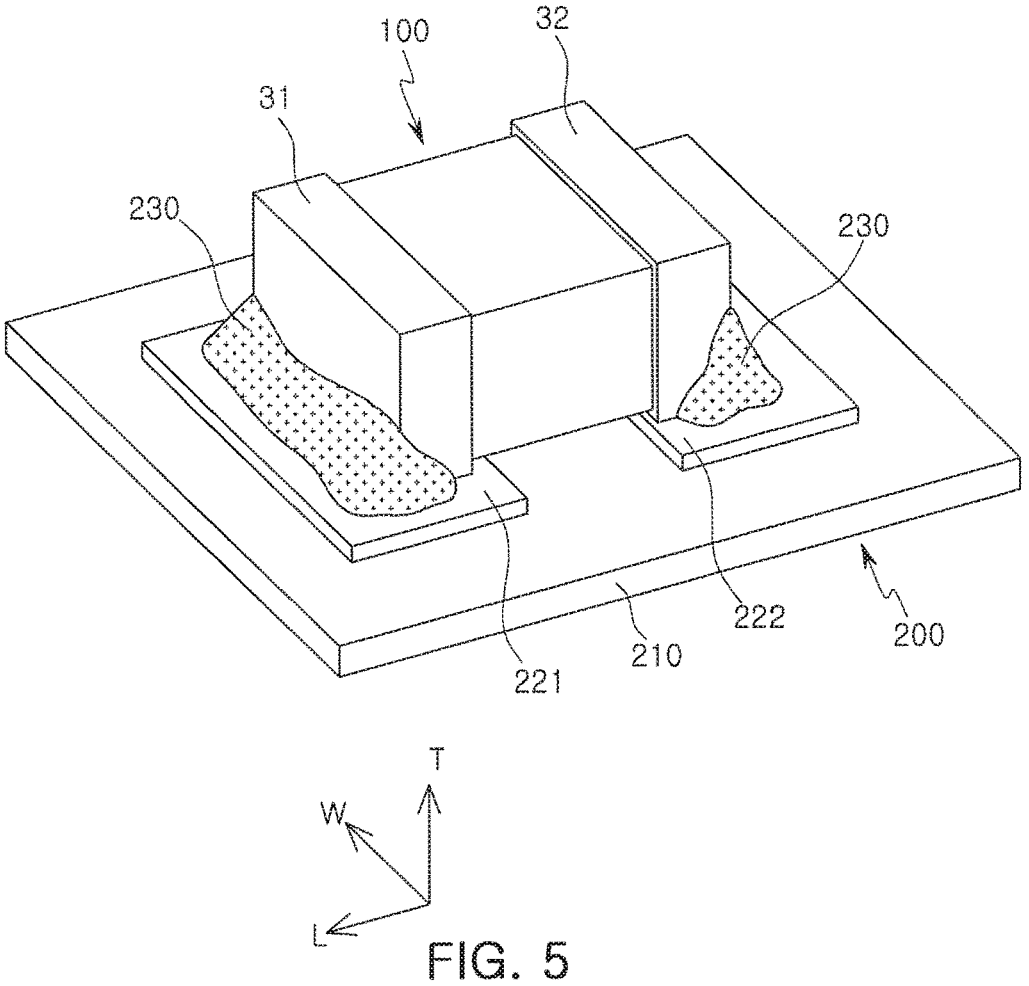
FIG. 5 is a perspective view illustrating a case in which the chip electronic component of FIG. 1 is mounted on a printed circuit board.

FIG. 5 is a perspective view illustrating a case in which the chip electronic component of FIG. 1 is mounted on a printed circuit board ("PCB") 210.

Referring to FIG. 5, a mounting board 200 of a chip electronic component 100 according to an exemplary embodiment in the present disclosure may include a PCB 210 on which the chip electronic component 100 is mounted in a horizontal direction, and first and second electrode pads 221 and 222 that are spaced apart from each other on an upper surface of the PCB 210.

In this case, the chip electronic component 100 may be electrically connected to the PCB 210 by a solder 230 while the first and second external electrodes 31 and 32 are positioned to contact the first and second electrode pads 221 and 222, respectively.

Except for the above description, repeated descriptions of the features of the chip electronic component according to the above exemplary embodiment in the present disclosure will be omitted here.

As set forth above, in a chip electronic component according to an exemplary embodiment in the present disclosure, an area of an end surface of a coil conductor pattern constituting an inductor may be maximized to minimize direct current resistance Rdc.

Distribution of a plating thickness of all coil conductor patterns may be minimized to obtain designed direct current resistance Rdc.

In addition, a plating surface without burning on a coil conductor pattern may be obtained to reduce the incidence of defectiveness.

While exemplary embodiments have been shown and described above, it will be apparent to those skilled in the art that modifications and variations could be made without departing from the scope of the present invention as defined by the appended claims.

What is claimed is:

1. A chip electronic component comprising:

a magnetic main body including an insulating substrate and a coil conductor pattern disposed on at least one surface of the insulating substrate; and external electrodes disposed on first and second ends of the magnetic main body so as to be connected to an end of the coil conductor pattern, wherein the coil conductor pattern includes a pattern plating layer and a first plating layer disposed on the pattern plating layer, and a thickness of the first plating layer of innermost and outermost coil conductor patterns of the coil conductor pattern is greater than a thickness of the first plating layer of an inner coil conductor pattern disposed between the innermost and outermost coil conductor patterns, the coil conductor pattern further includes a second plating layer disposed on the first plating layer, and a thickness of the second plating layer of the innermost and outermost coil conductor patterns of the coil conductor pattern is shorter than a thickness of the second plating layer of an inner coil conductor pattern disposed between the innermost and outermost coil conductor patterns.

2. The chip electronic component of claim 1, wherein thicknesses of the first plating layer of the inner coil conductor patterns are the same.

3. The chip electronic component of claim 1, wherein Wa'<Wa, where Wa is a width of a pattern plating layer of innermost and outermost coil conductor patterns of the coil conductor patterns and Wa' is a width of a pattern plating layer of the inner coil conductor pattern disposed between the innermost and outermost coil conductor patterns.

4. The chip electronic component of claim 3, wherein widths of the pattern plating layer of the inner coil conductor patterns are the same.

5. The chip electronic component of claim 1, wherein a width of the second plating layer is substantially the same as a width of the first plating layer.

6. The chip electronic component of claim 1, wherein ta'<ta, where ta is a thickness of the first plating layer of the innermost and outermost coil conductor patterns of the coil conductor patterns and ta' is a thickness of the first plating layer of the inner coil conductor pattern disposed between the innermost and outermost coil conductor patterns.

7. A chip electronic component comprising:

a magnetic main body including an insulating substrate and a coil conductor pattern disposed on at least one surface of the insulating substrate; and external electrodes formed on first and second ends of the magnetic main body so as to be connected to an end of the coil conductor pattern, wherein the coil conductor pattern includes a pattern plating layer and a first plating layer disposed on the pattern plating layer, and Wa'<Wa, where Wa is a width of a pattern plating layer of innermost and outermost coil conductor patterns of the coil conductor patterns and Wa' is a width of a pattern plating layer of an inner coil conductor pattern disposed between the innermost and outermost coil conductor patterns, the coil conductor pattern further includes a second plating layer disposed on the first plating layer, and a thickness of the second plating layer of the innermost and outermost coil conductor patterns of the coil conductor pattern is shorter than a thickness of the second plating layer of an inner coil conductor pattern disposed between the innermost and outermost coil conductor patterns.

8. The chip electronic component of claim 7, wherein widths of the pattern plating layer of the inner coil conductor patterns are the same.

9. The chip electronic component of claim 7, wherein a width of the second plating layer is substantially the same as a width of the first plating layer.

10. The chip electronic component of claim 7, wherein ta'<ta, where ta is a thickness of the first plating layer of the innermost and outermost coil conductor patterns of the coil conductor patterns and ta' is a thickness of the first plating layer of the inner coil conductor pattern disposed between the innermost and outermost coil conductor patterns.

11. A method of manufacturing a chip electronic component, comprising steps of:

forming a coil conductor pattern by forming a pattern plating layer on an insulating substrate and forming a first plating layer on the pattern plating layer, and forming a second plating layer on the first plating layer;

forming a magnetic main body around the coil conductor pattern; and forming external electrodes on first and second end surfaces of the magnetic main body so as to connect to ends of the coil conductor pattern, wherein Wa'<Wa, where Wa is a width of the pattern plating layer of innermost and outermost coil conductor patterns of the coil conductor patterns and Wa' is a width of the pattern plating layer of an inner coil conductor pattern disposed between the innermost and outermost coil conductor patterns, and a thickness of the second plating layer of the innermost and outermost coil conductor patterns of the coil conductor pattern is shorter than a thickness of the second plating layer of an inner coil conductor pattern disposed between the innermost and outermost coil conductor patterns.

12. The method of manufacturing a chip electronic component of claim 11, wherein a width of the second plating layer is substantially the same as a width of the first plating layer.

13. A method of manufacturing a chip electronic component, comprising steps of:

forming a coil conductor pattern by forming a pattern plating layer on an insulating substrate and forming a first plating layer on the pattern plating layer, and forming a second plating layer on the first plating layer;

forming a magnetic main body around the coil conductor pattern; and forming external electrodes on first and second end surfaces of the magnetic main body so as to connect to ends of the coil conductor pattern, wherein ta'<ta, where ta is a thickness of a first plating layer of innermost and outermost coil conductor patterns of the coil conductor patterns and ta' is a thickness of a first plating layer of an inner coil conductor pattern disposed between the innermost and outermost coil conductor patterns, a thickness of the second plating layer of the innermost and outermost coil conductor patterns of the coil conductor pattern is shorter than a thickness of the second plating layer of an inner coil conductor pattern disposed between the innermost and outermost coil conductor patterns.

14. The method of manufacturing a chip electronic component of claim 13, wherein Wa'<Wa, where Wa is a width of the pattern plating layer of the innermost and outermost coil conductor patterns of the coil conductor patterns and Wa' is a width of the pattern plating layer of the inner coil conductor pattern disposed between the innermost and outermost coil conductor patterns.

* * * * *